United States Patent [19]

Bance

[11] 3,999,336

[45] Dec. 28, 1976

[54] BUILDING DOME STRUCTURE

[75] Inventor: Jean A. Bance, North Chicago, Ill.

[73] Assignee: Roper Corporation, Kankakee, Ill.

[22] Filed: Apr. 7, 1975

[21] Appl. No.: 565,551

[52] U.S. Cl. ..... 52/80; 52/86; 52/463; 52/464; 52/747

[51] Int. Cl.[2] ..... E04B 1/342

[58] Field of Search ..... 52/80, 86, 81, 87, 395, 52/397, 461, 460, 665, 463, 638, 464, 14, 747

[56] References Cited

UNITED STATES PATENTS

| | | | |
|---|---|---|---|
| 1,156,981 | 10/1915 | Crocker | 52/463 |
| 1,677,650 | 7/1928 | Nelson | 52/464 |
| 1,846,772 | 2/1932 | Wallis | 52/638 X |
| 2,690,185 | 9/1954 | Pomykala | 52/80 X |
| 3,367,077 | 2/1968 | Johnston | 52/397 X |
| 3,380,203 | 4/1968 | Peterschmidt | 52/81 |
| 3,462,893 | 8/1969 | Kaiser | 52/80 |
| 3,485,519 | 12/1969 | Chiu | 403/297 X |
| 3,791,088 | 2/1974 | Sandow et al. | 52/200 |
| 3,830,029 | 8/1974 | Vance | 52/395 |
| 3,873,220 | 3/1975 | Kashiwabara | 403/292 X |
| 3,894,367 | 7/1975 | Yacoboni | 52/80 |
| R12,432 | 1/1906 | Degenhardt | 52/395 |

FOREIGN PATENTS OR APPLICATIONS

| | | | |
|---|---|---|---|
| 893,858 | 10/1953 | Germany | 52/463 |
| 1,011,138 | 6/1957 | Germany | 52/395 |
| 548,146 | 9/1956 | Italy | 52/80 |
| 37,160 | 4/1940 | Poland | 52/86 |
| 176,594 | 9/1961 | Sweden | 52/638 |
| 295,593 | 1/1954 | Switzerland | 52/463 |
| 1,232,489 | 5/1971 | United Kingdom | 403/235 |
| 103,350 | 1917 | United Kingdom | 403/178 |
| 686,152 | 1/1953 | United Kingdom | 403/234 |

OTHER PUBLICATIONS

Concrete, "Reinforced Concrete Hangers" Sept. 1921.

*Primary Examiner*—Price C. Faw, Jr.
*Assistant Examiner*—Leslie A. Braun
*Attorney, Agent, or Firm*—Fitch, Even, Tabin & Luedeka

[57] ABSTRACT

A building dome structure is formed by splicing long rafter sections into rafters and then lifting the rafters into positions extending meridionally between an upper compression ring and a lower tension ring. Then individual purlins are raised into positions between the adjacent rafters and attached thereto by purlin connecting means. Condensate channels along the rafter and purlin members collect condensation from glazing panels which are supported along their marginal edges by the rafters and purlins.

7 Claims, 9 Drawing Figures

BUILDING DOME STRUCTURE

This invention relates to a building dome structure having rafters, purlin and glazing panels or the like supported by the rafters and purlins.

Building dome structures having rafters and purlins, with glazing panels of transparent or translucent glass secured between them are used for a variety of purposes. These structures may be used as greenhouses, sports arenas, swimming pool structures, recreational centers and for a variety of other purposes. The rafters and purlins are usually constructed of lightweight metal, most often aluminum. Fitted into the area between the rafters and purlins are glazing panels of clear translucent or opaque glass, as desired, according to the purpose for which the dome structure is intended. For example, if the admittance of sunlight is unimportant, opaque glass or solid glazing panels may be used.

Because of the temperature differential that often exists in the winter between the atmosphere inside the dome and that outside, condensate collection on the inside surface of the glazing panels is often encountered. To prevent this condensate from dripping upon the occupants of, or the material stored within the dome structure, condensate channels are provided for collecting and conveying it to lower drainage points located about the circumference of the dome.

The deficiencies that exist in present dome structure systems are several. A major difficulty is the construction technique required to erect a dome structure. As shown in U.S. Pat. No. 3,462,893 and U.S. Pat. No. 3,380,203 to Peterschmidt, construction of dome buildings often requires that the vertical member be comprised of many sections joined together at a series of joints. The joints disclosed in these patents are also designed for insertably connecting the purlin members of the dome. Because of this particular kind of structure, the purlins must be attached as the dome is built from ground up. If the rafters are first completed, the nature of the joint prevents the purlin from later being affixed. As the dome must be erected section-by-section upwardly from the lower tension ring, it is not structurally sufficient to stand by itself. Thus, extensive scaffolding and reinforcement is required underneath the structure so as to provide support and rigidity until the rafters can be connected to the upper compression ring and to facilitate attachment of sections of the rafters to each other and the purlins to rafters. This construction technique requires additional investment for material and substantial amounts of labor and time.

Another deficiency with existing building dome structures is the problem of providing an adequate seal between the glazing panels and the purlin and rafter members which support the glazing panels. Thermal expansion and contraction of the metal framework of the dome often cause structural movements of up to three-fourths of one inch. When such movement is repeated from time to time, serious seal wear occurs and often the movement actually causes the seal to be displaced from its proper location.

Also a problem with existing dome structures which are comprised of vertical rafter members and substantially horizontal purlin members is "racking". Racking is the angular shift of structural members which derives from the inherent non-rigidity of a quadrilateral structure. In existing dome structures, racking forces are often absorbed (and thus rigidity is provided) by the glazing panels. The difficulty with this technique of providing structural rigidity is that often building authorities will not permit such construction and alternative means must be found to provide structural rigidity.

Accordingly, a general object of this invention is to provide a new and improved dome structure of the foregoing kind and a method of making the same.

Another object of this invention is to provide a building dome structure which is substantially weathertight and leak resistant.

A further object of this invention is to provide a building dome structure which is sufficiently rigid without using the glazing panels as primary stress absorbers.

These and other objects of the invention are more particularly set forth in the following detailed description and in the accompanying drawings of which:

Figure 1:
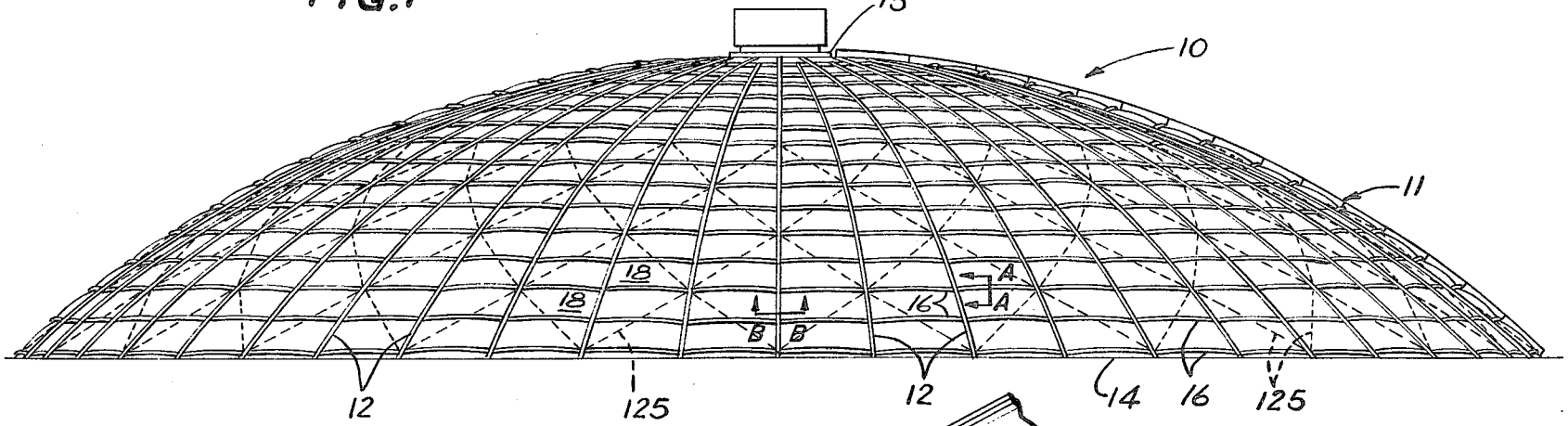
FIG. 1 is a side view of the building dome structure.

As shown in the drawings for purposes of illustration, the invention is illustrated in a dome-like structure 10 of generally hemispherical shape having a skeletal framework 11 comprised of a series of generally vertically extending rafters 12 disposed at generally meridionally locations about the circumference of the dome-like structure and extending between a lower circular tension ring means 14 and an upper circular compression ring means 15. A series of purlins 16 are joined between each pair of adjacent rafters 12 and the purlins are aligned along generally circular lines on the dome-like structure to form with the rafters a grid work of generally rectangular shaped supports for glazing panels 18.

As disclosed in U.S. Pat. No. 3,462,893, a common connector is used at each of the intersections of the purlin and rafters to join two adjacent rafter sections. With this manner of construction, the rafters were assembled piece by piece with the purlins from the ground upwardly. A large scaffolding reinforcement was built beneath the assembly of purlins and rafters to support them as the individual rafters and purlins were attached individually and circular arrangement was constructed step by step toward the top of the framework. Such a technique has been found to be time-consuming and costly.

In accordance with the present invention, an improved dome-like structure 10 may be erected in a quicker and a more efficient manner by first joining very long rafter sections 21 together on the ground to form completed rafters 12 which then are lifted into place and joined at their upper and lower ends to the compression ring means 15 and tension ring means 14 prior to assembling the purlins as in the above-described prior art method. Thus, in accordance with the preferred embodiment of the invention, the rafters 12 are first assembled to provide an outer supporting ribbed sub-framework to which the purlins may be attached by separable connecting means 23 which are preferably separate from splicing means 24 used to splice together several rafter sections 21 to form completed rafters. As will be explained in greater detail, as the space between adjacent rafters decreases continually in the upward direction, the purlins with their connecting means 23 fastened to each end thereof may be lifted into position to abut the pair of adjacent supporting rafters for connection thereto.

Turning now in greater detail to the individual members of the framework 11, the rafters 12 are most often made from extruded aluminum or other lightweight metal. Each rafter section 21 is extruded with a predetermined length, e.g., 30 feet and in a predetermined curvilinear shape to be joined to several other rafter sections so that when raised into place, the rafter will generally lie on a meridional line of the dome structure. Such rafter sections 21 have lengths greater than the length of any one glazing panel 18 so that each rafter section supports the edges of several glazing panels.

Figure 4:
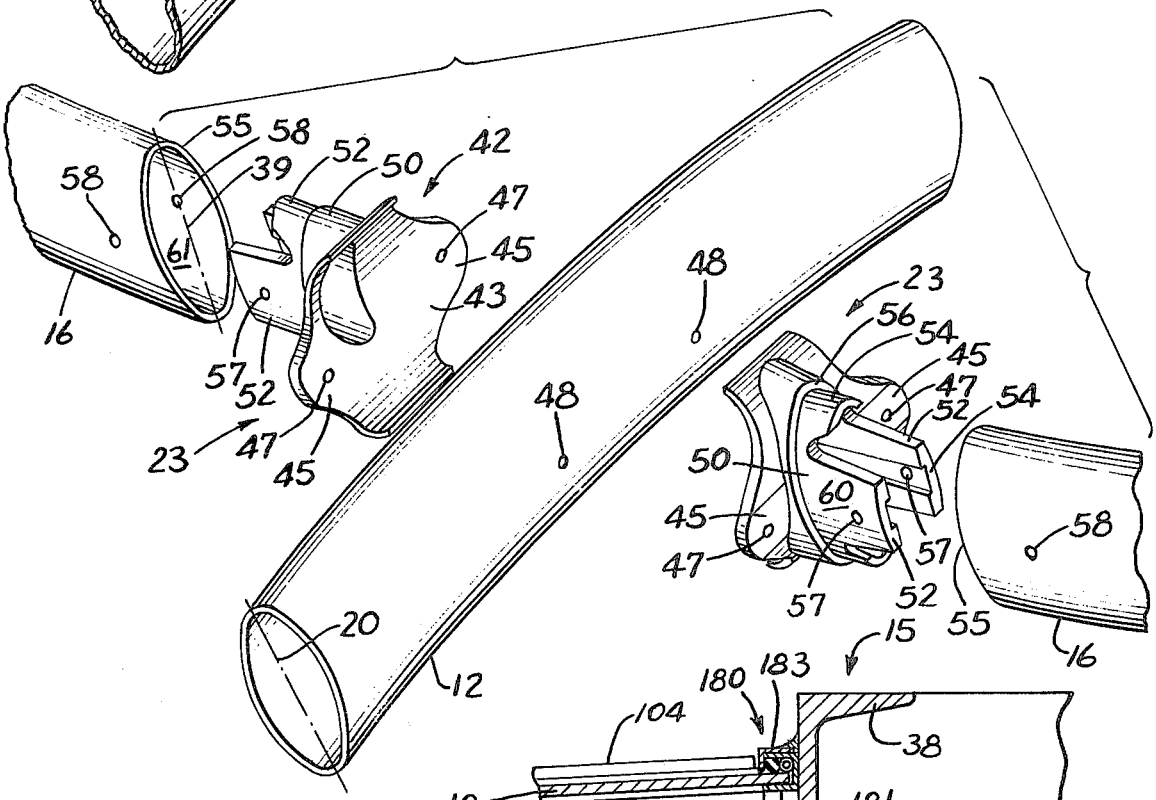
FIG. 4 is an exploded view of the purlin connecting means shown in FIG. 2.

The illustrated rafters 12 are hollow and have a roughly elliptical cross-section and they are positioned so that a major axis 20 (FIG. 4) of the ellipse is normal to the surface of the dome to provide greater bending strength than might otherwise be available. In the present embodiment, the major axis of the ellipse is approximately 8 inches and the minor axis 4 inches in length with a wall thickness of about 0.312 inch; but this may be varied depending on the size of structure desired. The hollow feature of the rafter is very helpful in that it provides a convenient means for splicing and for attachment to the compression ring means 15 and tension ring means 14. A pair of grooves 25 (FIG. 6) may also be provided in the top surface of the rafters 12 to support the lower ends of the glazing panel support means as will be described hereinafter in detail.

Figure 2:
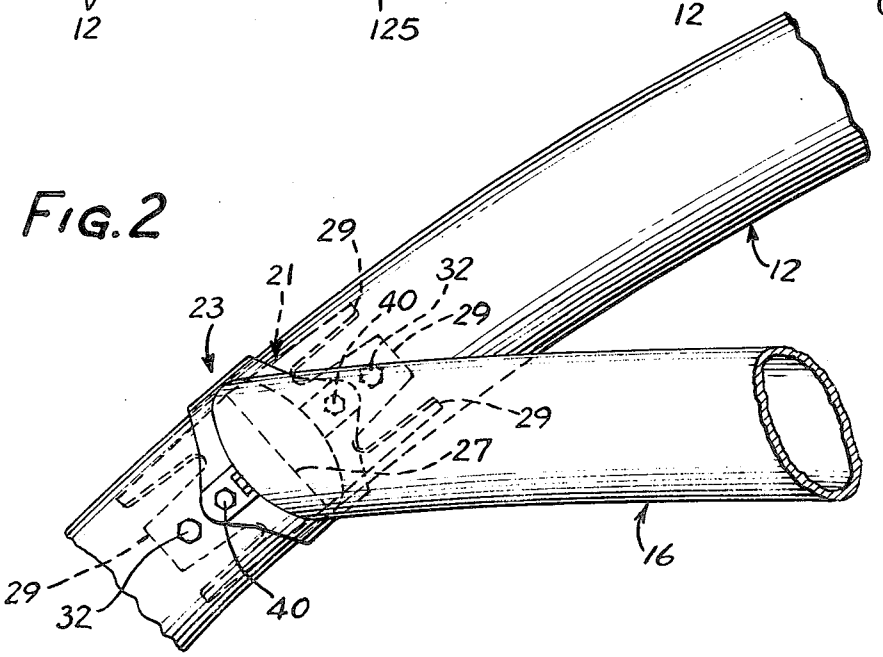
FIG. 2 is an enlarged fragmentary view, partially in section, of a rafter member with an attached purlin and with a splice for connection of two rafter sections.

In contrast to the very short rafter sections disclosed in U.S. Pat. No. 3,462,893 capable of supporting the edge of only one glazing panel, each of rafter sections 21 of the present invention has sufficient length to support several purlins and glazing panels; and the rafter sections 21 are preferably spliced together at locations where purlins 16 are also connected to the rafters, as shown in FIG. 2. However, it is possible to splice these long rafter sections 21 together at locations spaced from points of attachment of the purlins to the rafters. In any event, only a few such splicing means need be used as contrasted to the very short rafter sections which must be spliced together at each purlin and rafter intersection.

Figure 3:
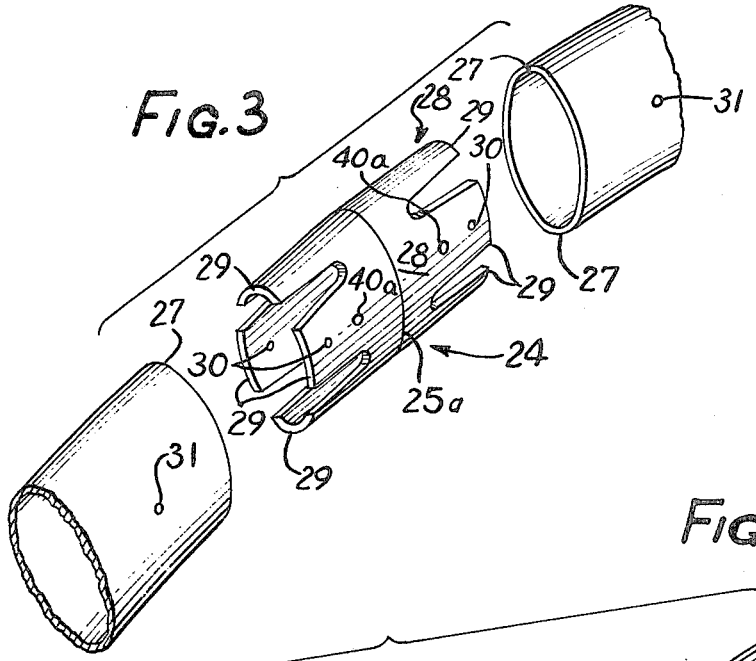
FIG. 3 is an exploded view of the splicing means for two rafter sections shown in FIG. 2.

The preferred splicing means 24 for joining the adjacents ends of the rafter sections 21, as best seen in FIGS. 2 and 3, comprises an elongated aluminum cast body 28 having an elliptical shape with a maximum dimension portion 25*a* sized for telescoping into and for abutting the interior walls of the rafter sections 21 at their abutted ends 27. To facilitate insertion of the splice into the hollow ends of the rafters, the body of the splicing means is formed with four tapered fingers 29 at each end thereof. The fingers taper to smaller ends which define a smaller ellipse than that of the middle section 25*a*. At least two of the fingers are provided with bolt-receiving openings 30 therein for alignment with bolt-receiving openings 31 in the rafter sections for receiving bolts 32 (FIG. 2) for fastening the splicing means to each of the adjacent rafter sections. As best seen in FIG. 2, additional holes 40*a* are provided in the bodies 28 to accept the bolt shanks, as will be explained.

Figure 7:
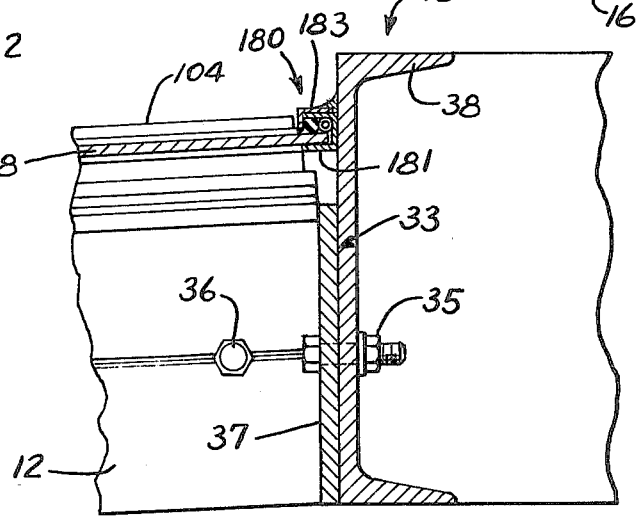
FIG. 7 is a partial, fragmentary view of attachment of one end of a rafter to a compression ring.
Figure 9:
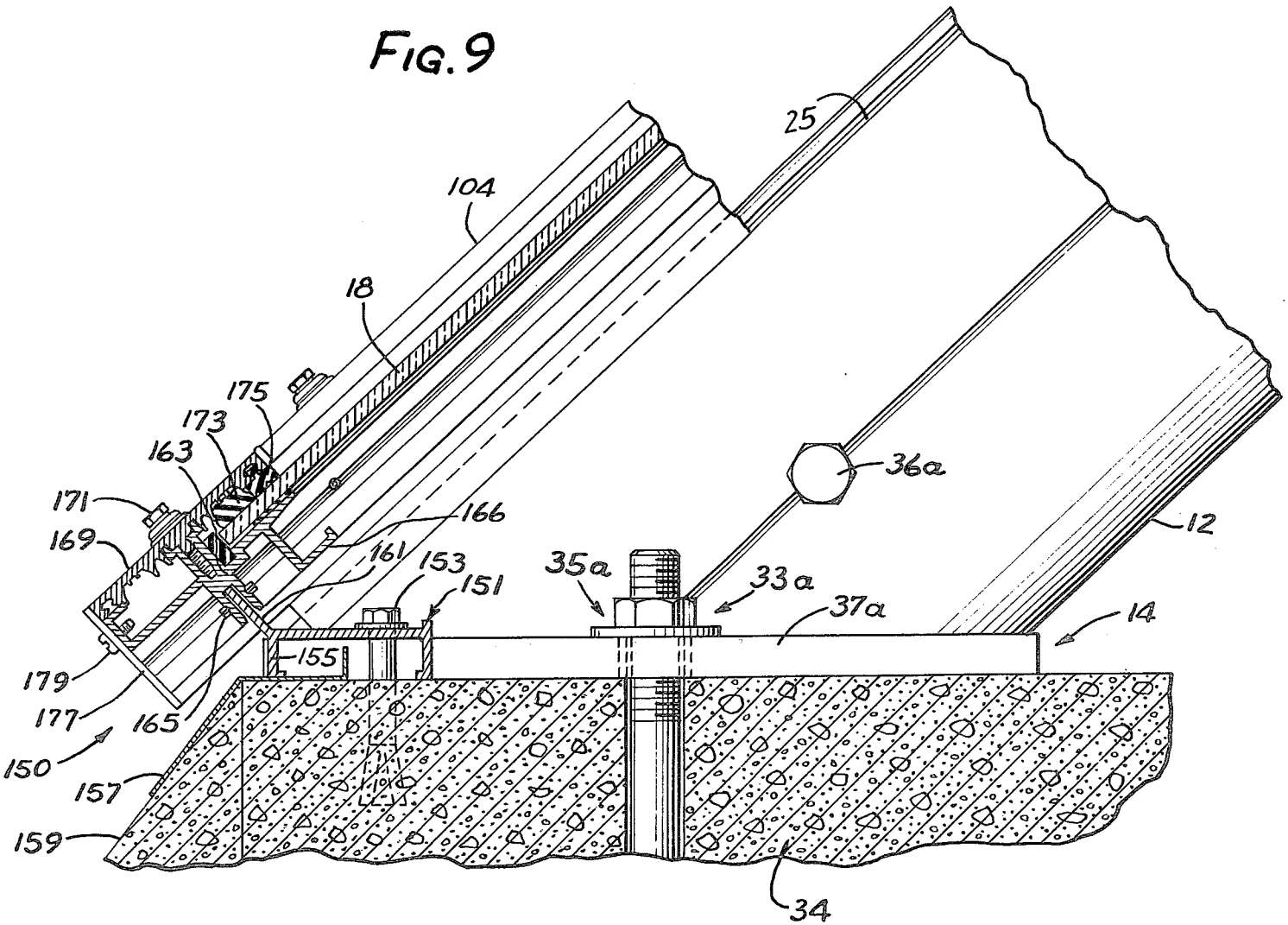
FIG. 9 is an enlarged fragmentary view of attachment of one end of a rafter to a tension ring.

The upper ends of the rafters 12 may be connected to the compression ring means 15 by an attaching means 33, as best seen in FIG. 7, having a cast aluminum body with outwardly projecting fingers which may be inserted into the hollow end portion of the rafter and secured thereto by bolts 36. A base 37 of the attaching means body is secured against a compression ring channel 38, which is part of the compression ring means 15, by bolt and nut fasteners 35 or by welding. Thus, a secure attachment is provided, but with minimal labor and time. In a similar manner, as best seen in FIG. 9, the lower ends of the rafters 12 can be attached to the lower tension ring means 14 by an attaching means 33*a* having a cast aluminum body with projecting fingers (not shown) inserted into the lower hollow end of the rafter 12 and secured thereto by bolts 36*a*. A base 37*a* on the attaching means body is secured by nut and anchor bolt fasteners 35*a* to concrete pad 34. Alternatively, the upper and lower ends of the rafters may be welded directly to the compression ring means and tension ring means, the former and latter being of conventional construction.

The advantages of first forming completed rafters to extend fully from the tension ring 14 to the compression ring 15 is most clearly seen in the construction techniques involved. First, the tension ring is generally constructed in place. The compression ring is next lifted and held in position by scaffolding a pole or a crane. After the rafter sections 21 have been spliced together on the ground to define a long rafter, the latter is then lifted by a crane into place with the lower end being secured to the tension ring and the upper end attached to the compression ring in a manner described above. After a number of rafters around the dome are raised into position, the sub-frame structure is basically self-supporting and only a minimum of temporary reinforcement, e.g., scaffolding and rigging, is required to maintain the structure as construction proceeds to add the prulins and glazing panels. The assembly of the rafter sections on the ground is much faster than the piece-by-piece assembly of the prior art rafters during the assembling of the structure.

After the vertical rafters 12 are in place, the purlins 16 may be positioned between and secured to pairs of adjacent rafters. The purlins, like the rafters, are preferably made of extruded aluminum or other lightweight metal and are preferably also of elliptical cross-section and positioned with a major axis 39 (FIG. 4) of the ellipse being normal to the surface of the dome structure so as to increase the load bearing strength of the structure. The purlins 16 may be curvilinearly shaped to correspond to the general curvature of the dome and are of various lengths, depending on whether they are to be positioned in the lower portion of the structure where the distance between rafters is larger or in the upper portion where the distance between rafters is smaller.

The time and labor involved in securing the purlins 16 to the rafters 12 is decreased by attaching one of the separable purlin connecting means 23 to each end of each purlin 16 on the ground with these connecting means then being secured by fastening means such as bolts 40 to the rafters 12. As presently embodied, the purlin connecting means 23 is in the form of aluminum castings 42 having a curved base flange 43 which is elliptically recessed so as to smoothly abut the outer lateral surface of the rafter. The flange 43 has a pair of outwardly extending ears 45 having apertures 47 therein for alignment with holes 48 drilled in the rafters so that bolts 40 may fasten a pair of purlin connecting means 23, as shown in FIG. 2, to each rafter at each purlin and rafter intersection.

For supporting the ends of the purlins 16, the connecting means 23 are formed with an elliptically projecting shaped abutment 50 and several projecting fingers 52 for telescoping into the hollow interior of the purlin. The abutment 50 is of substantially the same cross-sectional shape and area of the hollow interior of its purlin and is telescoped therein with the interior surface of outer peripheral surface 54 of the abutment. End wall 55 of the purlin may abut end surface 56 on the connecting means abutment to limit insertion of the abutment into the purlin. The fingers 52 are preferably inwardly tapered to facilitate insertion into the purlin 16 and, most importantly, to allow for the different angular adjustments that occur between the rafter and the purlin, depending on the vertical position of the rafter along the dome. That is, the angle between the rafters and the purlins approaches 90° in the lower portions of the dome, but becomes more acute in the upper area.

Figure 5:
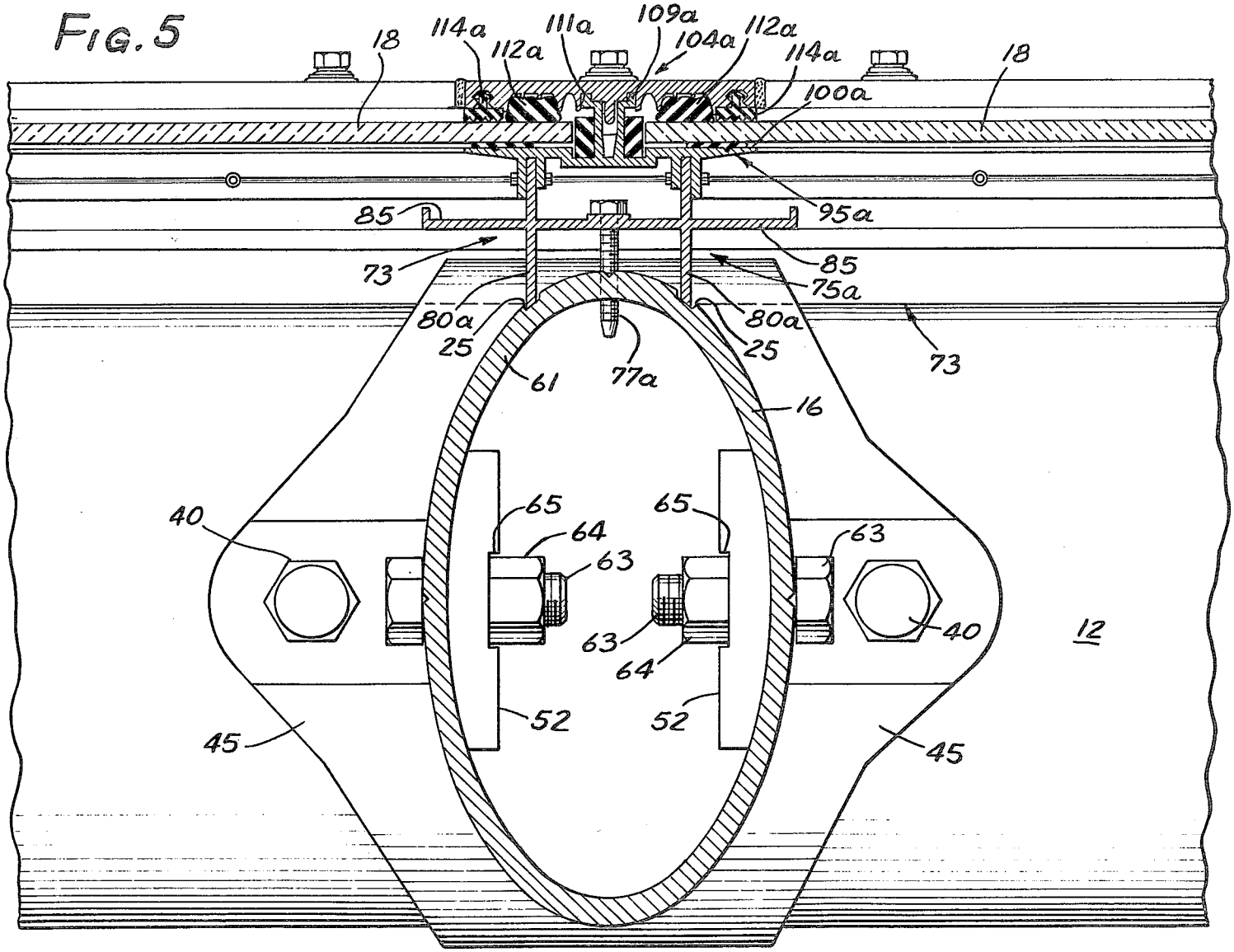
FIG. 5 is a sectional view taken along line A—A of FIG. 1.

By providing inwardly tapered fingers, which may be adjustably positioned, one casting can be used in any of these positions. Ends of the purlin are cut to the exact theoretical angle. Therefore, end wall 55 abuts surface 56 of the casting. The two vertically extending fingers 52 are drilled with holes 57 which match corresponding holes 58 in the purlin. Outer surfaces 60 on the fingers are curved for abutting the inner curved surfaces 61 of the purlins when drawn tight thereagainst by fasteners in the form of bolts 63 and nuts 64, as best seen in FIG. 5. The nuts 64 are received in channels 65 on the inner side of the fingers 52 and are held thereby against turning with the bolts 63 which heads are exposed for turning at the exterior of the purlins. Thus, the bolts may be tightened to draw the fingers snugly against the inside of each purlin, as shown more clearly in FIGS. 5 and 7, and secure it in place. Because the outer surface of the fingers corresponds to the inner surface of the hollow purlin, a snug and conforming attachment of the purlin to the connecting means 23 may be completed irrespective of the space therebetween initially.

The actual construction sequence is helpful in understanding the operation of the separable purlin attachment. A telescoping portion of a connecting means 23 is inserted into each end of a purlin 16 of predetermined length. Bolts 63 and nuts 64 are loosely joined to secure connecting means to each end of the purlin but still allow for later angular adjustment. The purlin is next positioned between adjacent rafters and hoisted upwardly. The distance between the rafters 12 decreases in an upwardly direction, and the purlin is raised to a predetermined point where it is compressively secured between them. A like operation is performed simultaneously between the next adjacent set of rafters. When both purlins are in place, bolts 40 may be inserted through the apertures in the ears 45 of one connecting means and completely through the holes 48 of the rafter and through the same holes of the corresponding connecting means which is connected to the purlin between the next adjacent set of rafters. The various bolts may then be tightened and the purlins securely fixed in place. This process is continued until the framework 11 is completed. At the locations of the splice bodies 28, the bolts are inserted through the openings 40*a* in these bodies.

Figure 6:
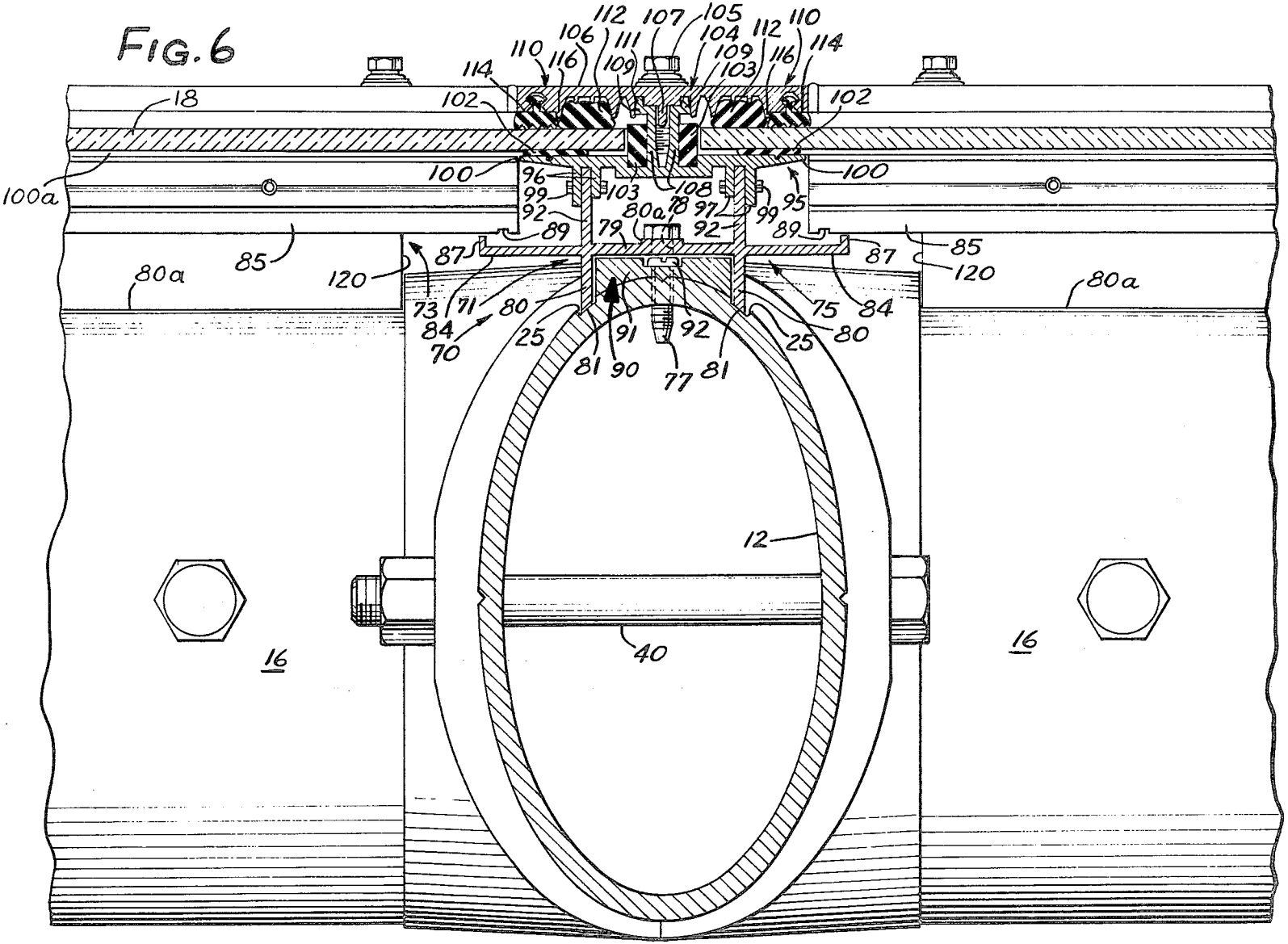
FIG. 6 is a sectional view taken along line B—B of FIG. 1.

Herein, the marginal edges of the glazing panels 18 do not rest directly on their supporting purlins 16 or rafters 12; but rest directly on a glazing support means 70, which in turn rests on the top of the rafters 12 and purlins 16, and are in the form of elongated extrusions or glazing supports 71 and 73 which also serve to collect and convey condensate or water seeping inwardly down along the rafters to water collection gutters. The glazing support 71 secured to the rafter 12, as best seen in FIG. 6, comprises a lower multi-channeled extrusion hereinafter termed a saddle 75 which extends along the top surface of the rafter and is fastened thereto by self-tapping screws 77 which extends through apertures 78 in webs 79 of the saddle. Preferably, the apertures 78 are in a raised central rib 80a so that water flowing along the top of the web will not collect about the screw 77 and leak through the apertures 78 in the web. The saddle is formed with a pair of laterally spaced depending flanges 80 having lower longitudinally extending edges 81 seated in the grooves 25 formed in the top of the rafters, the grooves holding the flanges 80 against spreading.

Condensate is collected from the glazing panels 18 and from the purlins 16 and conveyed downwardly to the base of the dome structure 10 by a pair of laterally extending condensate channels in the form of flanges 84 which extend laterally under the edges of the glazing panels and also beneath the ends of condensate channel flanges 85 on the purlin glazing supports 73. Upwardly turned edges 87 on the flanges 84 form troughs for collection of condensate which may drip from the interior surface of panels 18 and condensate which is directed to it by the purlin condensate channels. Preferably, the lower side of each purlin condensate flange 85 is provided with a notch 89 on its underside to restrict the flow of water in a rearward direction along the underside thereof. These notches assure that water will drop into the underlying rafter condensate channels and not flow beyond the upturned edges 87 whereby the condensate could fall freely within the dome structure.

To provide additional rigidity to the saddle 75 to resist bending of its flanges 80 with torsional forces applied thereto by loads applied to the dome structure, reinforcing means 90 in the form of a filler block 91 is disposed within and fills the space between the flanges 80 and the web 78 and the underlying purlin. The filter block 91 is preferably solid, aluminum and only about six inches long. The filler block has a concave lower surface which strides the top of rafter 12. The sides of the filler block 33 abut the inside of the saddle flanges 80; and, when fixed in place by self-tapping screws 92, the filler blocks absorb and transfer torsional forces while preventing substantial bending damage to flanges 80.

The saddle 75 further comprises a pair of spaced upwardly extending flanges 92 which extend longitudinally and provides a means for supporting the clamping and sealing means for the glazing panels 18 and provides a weatherproof connection therewith. The clamping and sealing means comprises an elongated extrusion or glazing bar 95 having two sets of downwardly extending flanges 96 and 97 defining a slot therebetween for receiving an upwardly extending flange 92 of the saddle. To prevent shifting of the glazing bars longitudinally along the saddle 75, transversely extending roll pins 99 are driven through aligned holes in the flanges 92, 96 and 97 at spaced locations.

The glazing bar 95 has a pair of laterally extending flat flanges 100 having upper flat surfaces for supporting adjacent edges of the glazing panels 18. Substantially flat seals 102 are disposed between the glazing panels 18 and flanges 100. The preferred seals 102 are flat butyl tapes having a centrally disposed internal nylon rod which assists the tape in retaining its shape and providing the seal for a longer time period under the weight and compressive forces encountered. Heretofore, flat tape seals without the nylon rod tended to crush and destroy the effectiveness of the seal.

The glazing bar 95 also supports a pair of glazing blocks 103 which are located in slots disposed inwardly of the seals 102 and which abut and cushion the edges of the glazing panels 18. The resiliency of the glazing blocks 103 allows the glazing panels to shift tightly from thermal expansion or contraction or racking.

The glazing panels 18 are secured in place by means of clamping or cap bar means 104 disposed on the exterior side of the glazing panels and secured by fasteners 105 to clamp the glazing panels tightly to the underlying glazing bars 95. Herein, the cap bar means 104 comprises an extrusion or bar 106 having a central depending flange 107 sandwiched between two parallel flanges 108 which extend upwardly from the glazing bar 95. Upper ends 109 of the parallel flanges 108 are inserted into grooves 111 on the central portion of the cap bars to support the cap bar means 104 at the locations of the fasteners 105. This arrangement also prevents any lateral movement of the clamping bar relative to the glazing bar.

To prevent leakage of water under the clamping bar 106, it carries a seal means 110 comprising an inner seal 112 and an outer seal 114 along both longitudinal edges thereof. Short depending ribs 116 on the underside of the cap bar 106 extend downwardly on opposte sides of the inner seal. The outer seal 114 is preferably made of extruded neoprene and is fitted into a dovetailed slot in the clamping bar 106 and serves a twofold purpose, first as a seal itself and secondly as a retainer for preventing loss of the interior seal 112 which is made of butyl. This double sealing serves to retain the butyl inner seal against working out of its sealing position with expansion, contraction, or a shifting movement of the glazing panels, these movements being as much as 0.75 inch for Plexiglas glazing panels.

The other edges of the glazing panels 18 supported by the purlins 16 are supported by substantially identical structures to that described in connection with the support of the first edges of the glazing panels. Therefore, the same reference characters with a suffix *a* added have been used to designate the elements in FIG. 5 on the purlin 16 for performing the same function for the rafters and illustrated in FIG. 6. As best seen in FIG. 6, the depending saddle flanges 80*a* on the purlin saddle 75*a* are severed at end walls 120 short of the connecting means 23 to avoid interference therewith. The condensate carrying flanges 85 are at a higher elevation for the discharge of condensate collected from the purlins and from the edges of the glazing panels supported thereby, for discharge into the rafter condensate channels 84 for flowing downwardly along the rafters 12 to collecting points for discharge from the dome structure. The glazing support flanges 100*a* on the purlins are, however, at the same height as the glazing support flanges 100 on rafters to provide a planar support for the glazing panels.

Because the dome structure is composed of a grid of generally quadrilaterally arranged purlins and rafters, it is subject to an angular shifting called "racking" in which the angles between the purlins and rafters shift. The glazing panels 18 add sufficient rigidity to satisfy some governmental building regulations; but for others one cannot rely on the rigidity of the glazing panels to withstand racking and other additional means must be provided. To increase the rigidity of the structure and reduce racking, a cross brace means 125, illustrated in FIGS. 1 and 8, has been added to the lower portion of the structure. The preferred cross brace means is in the form of angularly disposed tubular cross braces 126 of tubular aluminum construction which extends angularly between adjacent rafters. In the preferred embodiment, the angle of attachment of the cross brace to the rafter is approximately 46° and forms generally diamond patterns as shown in FIG. 1; but this may vary, depending on the pattern of cross bracing desired. The top of the structure with its smaller and more rigid quadrilateral areas need not be braced when the lower half or portion is well braced against racking.

Figure 8:
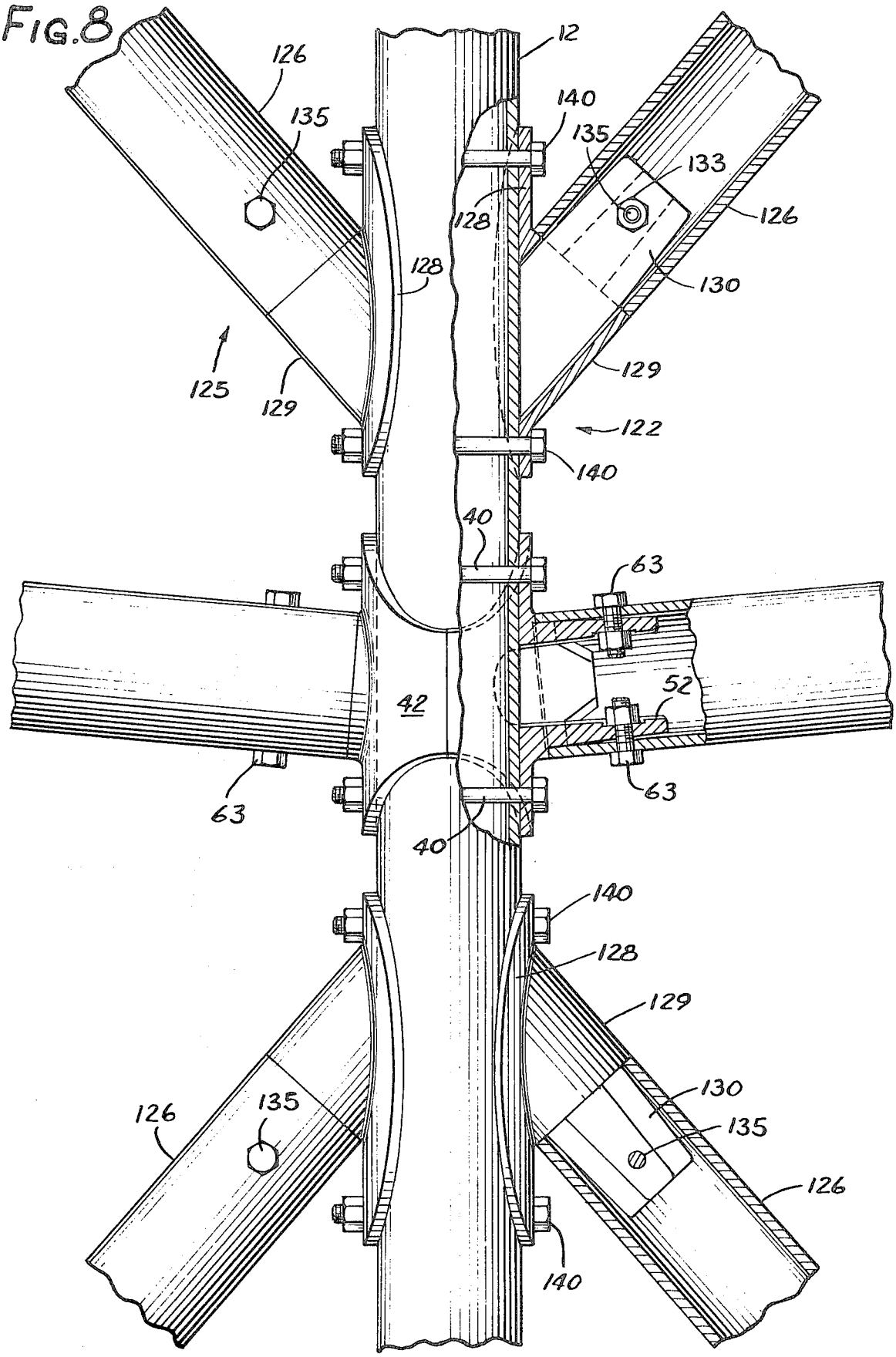
FIG. 8 is a fragmentary view, partially in section, of a portion of a rafter at a joint location where both purlin and reinforcing members are attached.

Each end of the cross braces 126 may be attached to a rafter 12 with connectors 127 which have bases 128 elliptically shaped to abut the side of the rafters 12. Projecting from each base 128 at the proper angle is an abutment 129 terminating in a free end having a plurality of fingers 130. The fingers are tapered to allow easier insertion into the hollow interior of a cross brace and to allow slight angular adjustment of the bracing. The fingers have grooves in their inner surfaces for receiving nuts 133 and bolts 135 are inserted through apertures in the fingers and in the tubular cross braces in a manner like that described above for the purlin. The connector is typically connected to the rafter by two bolts 140, as shown in FIG. 8, which simultaneously connect a like cross brace connector to the other side of the rafter. Alternatively, the cross braces may be cut with angular ends to abut the rafters and these ends may be welded directly to a plate similar to the plate 128 fastened by bolts such as the bolts 140.

For the purpose of providing a lower seal for the structure around the periphery of the tension ring means 14, a plurality of arcuately shaped channels 151 are secured by fasteners 153 to the concrete pad 34 at the outer side of the base plates 37*a*. The channels 151 have an outer vertical leg 155 which clamps the upper end of a flashing sheet 157 to the concrete pad. The flashing sheet has an outer portion secured to a sloping face 159 of the concrete pad. The channels 151 are formed with upwardly and obliquely extending flanges 161 to which is fastened a saddle 163 by roll pin fasteners 165. The saddle 163 is formed with a condensate gutter 166 and serves to support an end glazing cap 169 which is secured thereto by fasteners 171.

The end glazing caps 169 extend circumferentially about the structure and carry seals 173 and 175 which abut the top side of the lower ends of the glazing panels 18 to provide a lower peripheral glazing seal. An outer vertically extending strip 177 is fastened by screws 179 to the saddle 163.

In a similar manner, the upper peripherally extending ends of the glazing panels 18 are sealed by a peripheral sealing means 180 (FIG. 7), and include an outer glazing bar 181 secured to the vertical face of the channel 38 with an internal resilient seal 183 abutting the top peripheral surface of the glazing panels 18.

The present invention is also useful in buttress wall buildings (not shown) in which the lower ends of the rafters 12 are disposed outwardly of an outer vertical curtain wall extending circumferentially about the structure and joining the rafters at locations upwardly and inwardly of the extreme lower ends of the rafters which are joined to the tension ring means.

It can thus be seen that the present invention has many advantages. A building dome structure is provided that can be erected with a minimum of capital investment, time and labor. After several rafters are in position about the dome, it is essentially self-supporting and construction can proceed without taking the time and effort required for gradually building a latticework of structural support beneath the completed portion.

The separable purlin attachment means are designed for easy attachment and for minimum cost outlay while the separability feature makes construction more simple. The inwardly tapered fingers allow a single casting to be used at any of the locations within the dome and, by simple bolt attachment, the purlins can be fastened securely and snugly into place.

The functionality of the glazing and clamping bars is also very important. The simple clamping mechanism is an extremely easy way to secure the glass panels or glazing panels in place. Simultaneously, however, a double seal feature is provided which makes the structure much more weather resistant, and a system of condensation collection ducts is created to channel off any moisture seepage from the outside or condensate collection on the inside.

In a manner much like that used to install the purlins, the present invention also provides an easy way in which reinforcing members may be installed in the structure to prevent or at least minimize the characteristic angular shifting called "racking".

The present invention has been described in terms of its present and preferred embodiment. However, that does not impliedly exclude obvious variations or equivalents that may be used in the construction of this invention. For example, instead of being an aluminum extrusion, the purlins or rafters may be manufactured from other suitable materials. Likewise, the materials used for the seals in the weatherproofing may be varied, depending on the service desired.

Minor variations in shape or size could also occur. The rafters do not necessarily have to be of elliptical shape; they may be round or even rectangular. And the purlins do not necessarily have to be the same shape as the rafters.

In addition, certain bolted attachments could be replaced by welding or other means of securing one piece to another.

Various other features of the invention are set forth in the following claims.

What is claimed is:

1. A building dome structure comprising an upper compression ring means at the top of the dome structure, a lower tension ring means at the lower end of the structure, continuously curved vertical rafters extending meridionally between and connected to said lower tension ring means and said upper compression ring means, said rafters comprising a plurality of curved rafter sections joined end to end to form each rafter, a plurality of splicing means for each rafter joining said rafter sections together and forming the continuously curved rafter, a plurality of rigid and curved purlins spaced at predetermined locations along and extending between adjacent rafters and supported thereby, said purlins being arranged in continuous rings about said structure, a plurality of said purlin rings being located intermediate the spliced ends of said rafter sections, glazing panels extending between and supported by said rafters and said purlins, said rafters having portions for supporting a plurality of said purlins located in different rings, and purlin connecting means carried by said purlins for attaching said purlins to said rafter portions at a plurality of locations therealong, said purlin connecting means being aligned on opposite sides of each rafter and each comprising a curved base portion shaped to conformably abut a side of one of said rafters, means extending from each of said base portions and fastened to said purlins, and fastening means securing a pair of opposite aligned curved base portions to each rafter for supporting ends of adjacent purlins.

2. The building dome structure of claim 1 in which the said rafters are hollow, and in which said splicing means is insertable into the adjacent ends of rafter sections and includes a plurality of fingers extending in opposite directions and along a curved line for a rafter being inwardly tapered for ease of entry into said rafter sections.

3. The building dome structure of claim 1 in which a means on said purlins and rafters for supporting said glazing panels comprises a saddle extending longitudinally along the upper portion of said rafters and purlins, said saddle having downwardly extending flanges, said purlins and rafters being hollow and tubular in shape and having longitudinally extending grooves on the external surfaces thereof to receive said flanges, laterally extending flanges on said saddles for receiving and conveying condensate accumulating on the interior of said glazing panels, and means for securing said saddles to said rafters and purlins.

4. The building dome structure of claim 5 wherein a structural member is inserted and affixed between downwardly extending saddle flanges and has a curved surface abutting against a curved surface on said rafter so as to absorb torsional stresses and to reinforce said downwardly extending flanges against bending.

5. The building dome structure of claim 1 wherein a means for supporting said glazing panels is attached to said rafters and purlins comprises seal means having a first interior seal and a second outer seal to secure said first interior sealing means against substantial lateral movement.

6. A building dome structure in accordance with claim 1 in which reinforcing members in the lower portion of said dome structure extend diagonally between said rafters for holding said rafters and said purlins against racking.

7. A method of constructing a building dome structure comprising constructing a lower tension ring means, assembling a plurality of continuously curved rafters by splicing together individual curved rafter sections on the ground, supporting an upper compression ring means at a location at the top portion of the dome structure, affixing said rafters between the lower tension ring means and the upper compression ring means along a plurality of meridional lines, attaching connecting means onto the ends of a plurality of rigid and curved purlins of varying length, moving said purlins and their associated connecting means upwardly between two adjacent rafters until said connecting means abut said rafters at predetermined locations, affixing said connecting means to said rafters, and installing glazing panels on said purlins and rafters.

* * * * *